US006211816B1

(12) United States Patent
Westphal

(10) Patent No.: US 6,211,816 B1
(45) Date of Patent: Apr. 3, 2001

(54) PROCESS AND APPARATUS FOR TARGET OR POSITION RECONNAISSANCE

(75) Inventor: Robert Westphal, Nuremberg (DE)

(73) Assignee: Diehl Stiftung & Co., Nürnberg (DE)

( * ) Notice: Subject to any disclaimer, the term of this patent is extended or adjusted under 35 U.S.C. 154(b) by 0 days.

(21) Appl. No.: 09/162,978

(22) Filed: Sep. 29, 1998

Related U.S. Application Data

(63) Continuation-in-part of application No. 08/602,335, filed on Feb. 16, 1996, now abandoned.

(30) Foreign Application Priority Data

Feb. 18, 1995 (DE) ..... 195 05 527

(51) Int. Cl.[7] ..... G01S 13/00
(52) U.S. Cl. ..... 342/357.03; 342/62
(58) Field of Search ..... 342/357.02, 357.03, 342/357.08, 357.09, 62, 63, 64

(56) References Cited

U.S. PATENT DOCUMENTS

| | | | |
|---|---|---|---|
| 4,954,833 | 9/1990 | Evans et al. . | |
| 4,990,922 | 2/1991 | Young et al. . | |
| 5,187,485 | 2/1993 | Tsui et al. . | |
| 5,517,419 | 5/1996 | Lanckton et al. . | |
| 5,554,994 * | 9/1996 | Schneider | 342/357.06 |
| 5,563,607 | 10/1996 | Loomis et al. . | |

FOREIGN PATENT DOCUMENTS

| | | |
|---|---|---|
| 3313648 | 8/1987 | (DE) . |
| 3640427 | 11/1988 | (DE) . |
| 3932548 | 4/1991 | (DE) . |
| 4104800 | 8/1992 | (DE) . |
| 4136136 | 3/1993 | (DE) . |
| 4135047 | 4/1993 | (DE) . |
| 4213110 | 10/1993 | (DE) . |
| 4224645 | 1/1994 | (DE) . |
| 4234878 | 4/1994 | (DE) . |
| 4312670 | 10/1994 | (DE) . |
| 4411725 | 10/1994 | (DE) . |
| WO 94/14082 | 6/1994 | (WO) . |

OTHER PUBLICATIONS

Mansfeld (1988) "Funkortungs–und Navigationssystem NAVSTAR–GPS" , *Radio Fernsehen Elekronik,* Berlin 37, 12, pp. 796–799. (No Translation).

(List continued on next page.)

*Primary Examiner*—Gregory C. Issing
(74) *Attorney, Agent, or Firm*—Scully, Scott, Murphy & Presser

(57) ABSTRACT

Items of relative target location information (19) which are obtained on board a platform serving as a sensor carrier (13) for target or position reconnaissance are combined, with association with the navigation satellite system time (34), with items of absolute mission location information (25) which are obtained on board the sensor carrier (13) from the satellite navigation orbit data (22), in order to obtain absolute target position data in which however, due to the system, there is still contained the absolute residual error of the order of magnitude of some ten meters, from the satellite-aided mission location determination. In order that the absolute target position data can also be made still more precise later, for effective use of the artillery (27), at a geodetically accurately known reception location (28) the deviation (33) between the location coordinates (32) and the items of reception location information (29) obtained on different platforms (13) and/or at different times and put into intermediate storage can also still be corrected at a later time by the deviations (33) associated in respect of system time, in order to obtain absolute target position data (36) which are independent of the satellite navigation residual error, for example for comparing the knowledge from the different, even time-displaced reconnaissance missions, for controlling the artillery (27).

1 Claim, 1 Drawing Sheet

OTHER PUBLICATIONS

Nordwall (1993) "AOPA Shows Benefits of D–GPS Versus ILS" , *Aviation Week & Space Techn.,* p. 57.
Randow (1992) "Himmlisch geführter Blindflug" , *Die Zeit Nr.26,* p. 19. (No Translation).
Randow (1994) "Satelliten führen sicher auf den Punkt" , *Flug Revue,* pp. 66–71 (No.Translation).
Tiemeyer et al. (1994) "Ambiguity Resolution of GPS L1 Carrier–Wave Measurements for High Precision Aircraft Navigation" , *Z. Flugwiss. Weltraumforsch* 18:323–333.
Haeffner (1993) "KZO/BREVEL" , *Soldat Und Technik* 1:26–29. (No Translation).

"UdSSR gibt Glonass frei" , *Funkschau,* p. 16 (1988). (No Translation).

"Satellitensignale und Meβverfahren" *Funkschau,* p. 60 (1989). (No Translation).

* cited by examiner

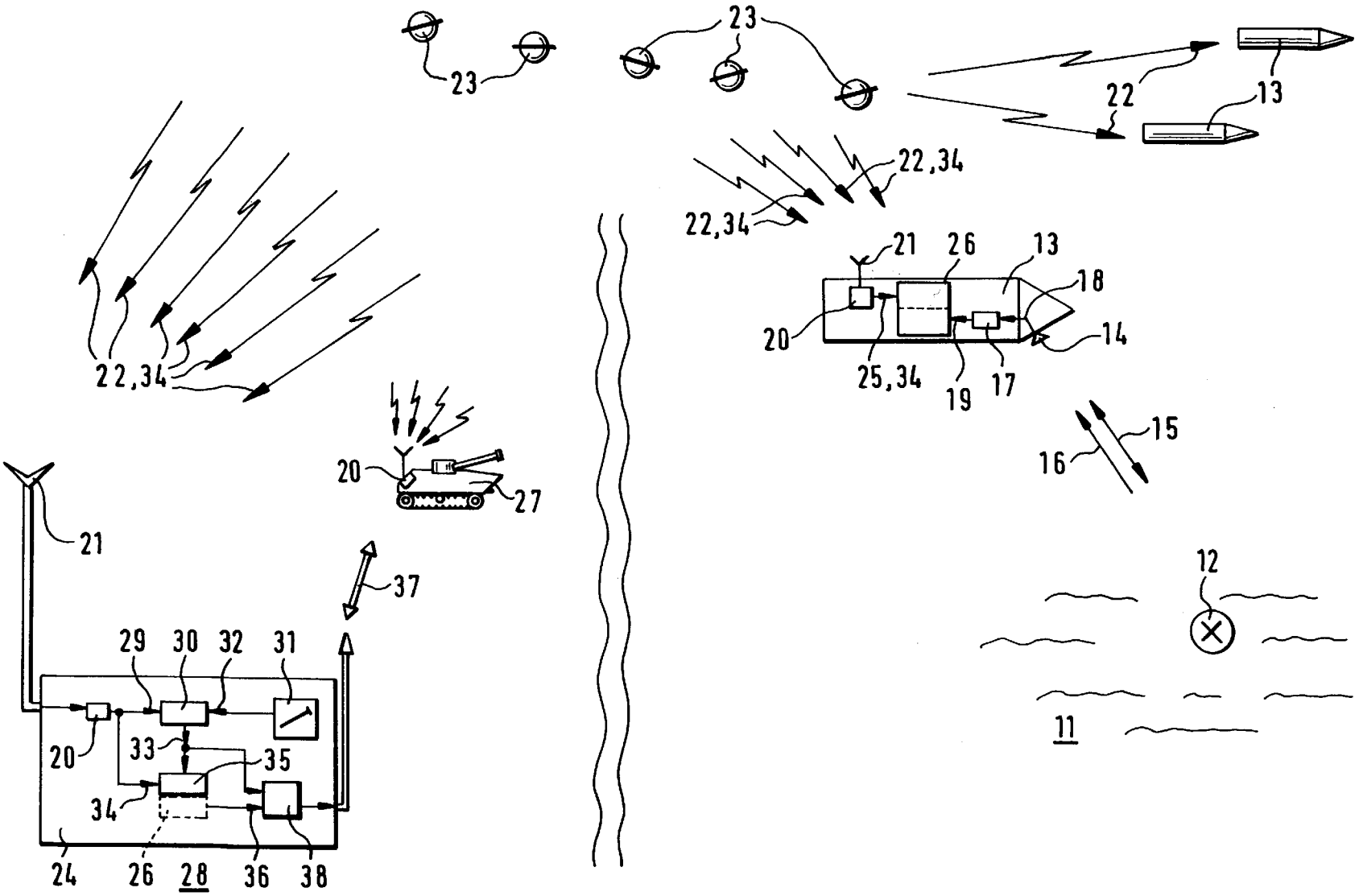
13
22
23
22,34
21
26
18
14
13
17
19
25,34
20
15
16
12
11
27
37
31
32
30
29
35
33
34
38
36
28
24

PROCESS AND APPARATUS FOR TARGET OR POSITION RECONNAISSANCE

CROSS-REFERENCE TO RELATED APPLICATIONS

This application is a continuation-in-part patent application of Ser. No. 08/602,335; filed Feb. 16, 1996 abandoned.

BACKGROUND OF THE INVENTION

1. Field of the Invention

This invention relates to a process for target or position reconnaissance, and to an apparatus for implementing the process. More specifically, the invention is directed to a novel method and apparatus for artillery guidance in correlation with the content of a mission memory storage of reconnaissance platforms.

2. Discussion of the Prior Art

A process and an apparatus for target or position reconnaissance is known from the article "KZO-BREVEL" by P. Haeffner, in SOLDAT UND TECHNIK, Issue 1/1993, pages 26 et seq. describing, by way of example, the use of a drone as an aid for artillery guidance and control through target spotting reconnaissance, and which is supplemented with overlapping comprehensive position scouting. Instead of a self-controlled or remote-controlled drone, it is also possible to employ articles of reconnaissance submunition as sensor carriers; such as in the form of airborne bodies of the type described in German Laid-open Patent Appln. DE-OS 33 13 648, or scatter ammunition as described in German Laid-open Patent Appln. DE-OS 41 04 800. Especially in the two last-mentioned instances, reconnaissance information which has been obtained about the enemy territory must, in every case, be immediately transmitted to a ground station which controls the reconnaissance action. This entails considerable expenditures with regard to the provision of technical equipment for setting up a stable, and eventually through the interposition of relay stations, wide ranging radio connection, thereby increasing the danger of betrayal to enemy defensive capabilities. In contrast therewith, a drone with interim stored reconnaissance data can be again recovered, and as a result does not require any communication link with the ground station.

Usually the positions on the terrain which are of interest relative to the instantaneous location of the sensor carrier are measured by means of methods involving reflective beam position finding (directional and running time evaluation). Thereby, a more or less greater error has to be taken into consideration, depending upon the apparatus parameters. This targeting error is still further increased by virtue of the fact that even through the use of satellite navigation (GNSS-GPS or -GLONASS; as described in FUNKSCHAU, Issue 17/1988, page 16, lower left) there are encounted positional uncertainties in the order of magnitude of several tens to hundreds of meters during the determination of the mission position finding on board the senor carrier; and in any event, as long as the NAVSTAR-precision code is not accessible. This error in position measurement, which can be traced back to clock synchronization errors and orbiting errors (satellite orbit deviations) enable themselves to be reduced when through a so-called relative spot determination were to be undertaken by simultaneous comparative measurements at the same satellite from different positions (FUNKSCHAU, Issue 24/1989, page 60, bottom center); or when from a geodetically measured reception location, the actually prevailing deviation of a satellite-supported positional determination were to be communicated to the mobile receiver (refer to German Patent Specification 41 36 136). However, such corrective measures require maintaining a constant data radio link between the ground station and the current mission location; and any items of corrective information which may be obtained therefrom are against lost if the relevant reconnaissance data are transmitted by way of undefined radio links at one of a plurality of possible locations which, in practice, cannot be predetermined, and later on cannot be determined; such as having to be transmitted into an integrated weapon guidance and control system, and then processed therein, from different of such locations and further transmitted. For example, a target point is to be located by a surveying procedure a plurality of times, and critical movements by enemy units are to be inferred from the subsequently observed target point movement. However, for this purpose, the decision-maker is presented with items of reconnaissance information from various equipment carriers and/or which have been obtained at different points in time which, precisely considered, he cannot combine in order to provide a comprehensive communication, because each individual item of information is possibly tainted with an unknown positional error. More specifically, reliable results are no longer attainable because it is already impossible to reliably determine the current actual position of the various reconnaissance platforms, and during the subsequent positional analysis, the positional errors encountered at that time are unknown.

SUMMARY OF THE INVENTION

In recognition of those factors, the present invention is based on the object, that in relation to items of satellite navigation-assisted reconnaissance information, even without the requirement of an on-line data link with the sensor platform, and even without the availability of the GPS-precision code, of being able to substantially increase the degree of accuracy of the positional information, in particular, when those items of information are first to be evaluated in a timed sequence, and combined with other items of reconnaissance information.

In accordance with the invention the foregoing object is essentially attained in that as many as possible of the navigation satellites which are to be considered for determining the mission location on board the sensor carrier are received at the same time from a geodetically accurately located station, and the sequence of items of location information ascertained in that manner, or the difference thereof with regard to the geodetically determined position is stored over the running satellite system time. The positional deviation which is associated with the current satellite configuration and which is documented over the satellite system time is then available as corrective information, when, subsequently, an item of reconnaissance information which, for example, has been placed into intermediate storage in the sensor carrier is evaluated. The target location information thereof, which has been falsified by the mission location error, can thus be subsequently corrected at that time with the deviation which was obtained at the same time, and which was stored with regard to the system time, thereby providing an item of target location or positional information, the accuracy of which could otherwise only by attained by means of the on-line DGPS, so that it is also possible for items of information obtained independently of each other to be subsequently combined without any loss of accuracy.

These items of positionally-corrected reconnaissance information, as a result, thus allow for a directed comparison of items of reconnaissance information which were assumed either successively or in parallel; for example, in order to be able to detect and assess troop marching movements or changes in the terrain. Thus, after the computing out of the deviation from the result of satellite navigation from the actual receiving location, which deviation had been given for the reconnaissance time and which was ascertained in a reference station and then stored, and which also applied to the instantaneous mission location of the sensor carrier, there only remains the uncertainty of the target vector from this observation platform to the measured target position, which can be considered at a good degree of approximation as being a system-governed constant; while the satellite navigation errors depend in a scarcely predicable manner on atmospheric conditions and the actual orbits of the presently being detected satellite.

The subsequent correction of the reconnaissance location or positional data which is now possible in accordance with the invention, thus also permits subsequent processing an evaluation of items of reconnaissance information which were not concurrently obtained, such as average value and stochastic evaluations, irrespective as to whether the current items of reconnaissance information were transmitted in an on-line operation through a radio link from the observation platform to the evaluation station, or whether they were delivered only at some time after the mission. Accordingly, due to the accurately known positional coordinates of the ground station, the determination of the deviation of the position can be presently ascertained from instantaneous satellite locations in a highly precise manner, especially as it can be carried out using multi-channel averaging operations from very many more satellite contacts than from a navigational receiver on board the sensor carrier; in effect, the moving observation platform.

In that manner, highly accurate target parameters are available for control over the utilization of the artillery weapons. Aiming of the weapon is also rendered more precise because the specific weapon location can be correlated through the same knowledge obtained in the ground station, by means of current satellite navigational errors. Thus, it is possible, by a correction of errors in satellite navigation, to not only subsequently improve the accuracy of positional determination, but also the degree of precision of the defensive media; for example, such as an artillery piece, or an artillery rocket which is equipped with GPS-control.

BRIEF DESCRIPTION OF THE DRAWING

Additional alternatives and developments and further features and advantages of the invention will be more apparent from the following description of a view of a typical reconnaissance scenario, which is shown schematically in the drawing, being restricted to what is considered to be essential. The single FIGURE of the drawing shows the use in coordination with a ground station of sensor carriers employed as reconnaissance platforms.

DETAILED DESCRIPTION OF A PREFERRED EMBODIMENT

Reiterating the above-mentioned basic concept of the invention, there is noted the following:

The inherent or actual local position can be determined through a reception from at least four navigational satellites. This positional determination is, however, quite imprecise. The imprecision is not constant, but is dependent upon the actual orbit of the individual satellites. The orbits are known, in essence, defined over a period of time. The satellite functions are predicated on an inherent system time basis (in effect, not on world time or on local earth or ground time, but on an internal system time, which is transmitted from the respective satellites with its identity information). This satellite system time period is the time variable for the definition of the satellite orbit (position measured over period of time).

There is implemented from a location on the ground, which has been geographically extremely precisely measured, a positional determination through the utilization of navigational satellites. Thereafter, there is obtained from the satellite navigation another positional determination and that of the actual trigonometrically measured position. This difference or distinction (positional deviation) is the navigational error. The navigational error, as mentioned, is not constant, but is dependent upon the actual orbit data derived from the satellite system-time. At a specific location, the fluctuation in the actually encountered navigational error is documented over the time interval of the internal satellite system time. This recorded document; in effect, does not employ the world time or local time as a time variable, but the internal system time which has been received from the satellites.

Reconnaissance sensor platforms (in essence; for example, espionage aircraft or pathfinder projectiles) determine the positional coordinates of a detected potential target object relative to the instantaneously inherent stationary location. The momentary or instantaneous inherent stationary location is determined through satellite navigation and stored in an uncorrected mode, but together with the actually received satellite system time. This positional information which has been obtained from the satellite navigation and stored on board the respective platform is, in essence, burdened with the actual satellite navigational error. As to the magnitude, the system point in time which is to be maintained for the satellite configuration, as previously mentioned is computed in another manner parallel to the mission of the platform at the geodetically defined receiving location, and stored in dependence upon the running of the internal satellite time period as corrective information.

Platforms which operate in sequence over the same terrain have their reconnaissance results stored while possessing different navigational errors. Consequently, at a later enemy position reconnaissance, the results cannot be superimposed, inasmuch as the same positional target object (for example, such as a camouflaged enemy position) was presumably differently located by the different platforms; and thus it is not known as to whether this relates to the same target object. When the reconnaissance results are evaluated later on, there can only be subsequently corrected the navigational error contained on board the platform for a certain satellite system point-in-time, however, only with the provided time corrective information and a satellite time system as a common time parameter for all platform reconnaissance results, in order to be able to correlate with each other the positional information originating from the different platforms.

Accordingly, the invention does not concern itself with the errors recorded on board the platforms which result from the satellite navigation, inasmuch as these errors are separately documented and stand available as corrective information (over the satellite system internal time period as the parameter), when later on, the platform reconnaissance information which is obtained either concurrently or offset in time, is to be combined for evaluation thereof.

The territory 11 which is to be inspected for target positional reconnaissance, with objects 12 contained therein which are of interest for target reconnaissance, is overflown by at least one sensor carrier 13 which, in accordance with the illustrated scenario, can be an unmanned aircraft, such as a so-called drone. Such a platform can be used with a program control or by remote control relatively far behind enemy lines and; for example, over a potential deployment area, in order to photograph the territory 11 for positional assessment and the potential targets located therein with their current positional coordinates for artillery control, or in order to be able to obtain information about the movement of enemy units from a comparison with previous photographs. In order to scan a wide strip of territory, a sensor carrier 13 can fly along a meandering path, or as may be assumed for the scenario illustrated in the drawing, a plurality of sensor carriers 13 are operated simultaneously side-by-side or in a timed sequence.

The carrier 13 is equipped with at least one sensor 14 in order to detect significant events taking place within the territory 11, or to acquire specified potential target objects 12. In the interest of obtaining a comprehensive scope of information, there may be operated simultaneously or in a parallel manner, preferably at least one active sensor 14; for example, a laser range-measuring device, and/or a microwave radar for reflective locating procedures 15, and at least one passive sensor, such as a radiometer and/or infra-red detector for radiation recordings or photographs 16 from the detected object 12 and its surroundings. It is possible that definitive target classification is not yet effected on board the sensor carrier 13, but in any event, the system involves preprocessing at 17 of the sensor signals 18 in order to provide items of reconnaissance information with items of relative target positional information 19; namely, relative to the instantaneous location of the sensor carrier 13. The sensor 14 is also designed to effect target positional determination in accordance with distance and direction relative to the sensor carrier 13, for example, by means of reflective position finding.

The instantaneous location of the sensor carrier 13 is, in turn, determined by a navigational receiver 20 which operates on board the platform, and the receiving antenna 21 of which receives the current orbit data 22 which are linked to the satellite system time 24 of at least three satellites; taking into account also the current altitude of the carrier of at least four navigational satellites 23, which can be detected over the horizon.

Inasmuch as it is assumed, for the present scenario, that there does not have to be any continuous communication link between the sensor carrier 13 and a ground station 24, the items of relative target positional information 19 from the sensor 14 and the items of error-subjected absolute mission location information 25 which are associated with the target location information 19 as measured over system time, from the navigation receiver 20 on board the sensor carrier 13, are transmitted into a mission storage or memory 26. Thereafter, the sequence of items of reconnaissance information which have just been obtained and which contain the relative target locations, and the absolute mission locations of the sensor carrier 13 which are ascertained in parallel therewith, are associated in the memory or storage 26 with the running of the satellite system time 34.

With regard to the above-mentioned station 24 at an accurately measured location 28, this can relate to a station which monitors and possibly remotely controls the use of the sensor carriers 13; however, it may also relate to a remote control post for positional assessment or for use by the deployed artillery 27 for defending against enemy target objects 12. The receiving location 28 which is occupied stationarily or quasi-stationarily by the station 24 during the mission of the sensor carriers 13 is, for example, geodetically located by surveying, or in any event very accurately known. This receiving location 28 is also determined continuously in parallel with the operation of the sensor carriers 13 by means of the carrier navigational receiver 20 whose receiving antenna 21 receives the orbit data 22 from if possible all navigation satellites 23 which can be presently detected, and evaluates such data in order to provide an item of receiving positional information 29. That information is compared in a comparator 30 with the positional coordinates 32 which are geodetically transmitted into a register 31 and, in that situation, the satellite navigational deviation 33 from the actual location, in association with the current satellite system time 34, is recorded into a corrective memory storage 35.

In this embodiment, after the completion of a reconnaissance mission, when there is recovered the mission memory or storage 26 with the items of relative target positional information 19 over the running of the system time together with the items of absolute mission positional information 25, with such recovery taking place after ejection of a drone or the like from the sensor carrier 13 or after landing thereof, the content of the storage or memory 26 can be evaluated in the ground station 24, or in some other suitable manner. Besides the signatures of objects 12 in the reconnoitered territory 11, the memory or storage content of interest is the absolute positional data of the objects. Although these items of data were admittedly ascertained only with respect to the instantaneous locations of the mission carrier 13, the items of absolute mission positional information 25 thereof, which are obtained over a period of time in the coordinate system which is fixed with respect to the earth, resulted from the actual satellite orbit data 22.

As already discussed above, these items of mission location information 25; in any event, when the precision code of satellite navigation is not available, involve an absolute deviation error 33 in an order of magnitude of several tens to hundreds of meters. This represents an excessively high uncertainty or error factor with regard to controlling the artillery 27. That error can now be compensated for achieving a firing precision against a target object upon evaluation of the content of the mission memory or storage or memory 35 in the ground station, because there is provided for each individual system moment in time, and thus for the sequence of all items of absolute mission location, informations 25 which are stored over the running of the system time 34 the deviations 33, which occurred at the respective system moments in time, for the entirety of the detectable satellite orbit data 22 from which a selection was received on board the senor carrier 13. Corrective linking of the items of relative target location or positional information 25 from which the deviations 33 have been deleted resultingly provides extremely precise absolute target positional data 36 for control or guidance 37 of the artillery 27, notwithstanding the inaccuracy of satellite navigation.

The guns of the artillery 27 may also be equipped with navigational receivers 20 for their own satellite navigation positional determination. Naturally, this also involves the typical inaccuracy of several tens of meters which, however, can be corrected by means of the deviation 33 which is currently ascertained at the ground station 24, and which in addition to the corrected absolute target positional data 36, is conveyed by way of radio signal control 37 through a transmitter 38 to the artillery 27. The item of absolute location or positional information, which are corrected in that manner and which are therefore highly precise with regard to the locations of both the artillery 27 and also a potential target object 12, thus ensure a highly accurate aiming of the artillery 27 and thus an optimum effect by the artillery 27 against the enemy target terrain 11.

In summation, the information with regard to the terrain which has been received by different sensors (wherein the information contains the different GPS-positional errors) is only compensated or correlated with each other subsequently at a later time, and in that during the observations of the terrain a time-dependent corrective information is obtained at a different precisely measured position. In this manner it is possible that the individual independently obtained information with regard to terrain are later on devoid of their time-dependent positional errors, and then positionally-correctly superimposed on each other so as to overall obtain particularly multiple reconnaissance information which is combined from different aspects; and which is especially utilized for artillery guidance.

What is claimed is:

1. An artillery guidance apparatus for target positional reconnaissance through items of target information obtained on board of a carrier (13) equipped with sensors (14), said sensors obtaining items of said target information; a navigational receiver (20) for obtaining items of absolute reconnaissance mission location information the items of target location information (19) and mission location information (25) being transmitted during said internal satellite system time period (34) into a mission memory (26) at said remote location (28) said items of target information and items of absolute mission location information being operatively associated with each other over a period of an internal system time (34) of a plurality of navigation satellites (23), the items of absolute mission location information (25) being compensated upon completion of the mission with deviations (33) in information satellite navigational deviation and current satellite system time stored in a corrective memory (35) at a remote location (28) during said period of internal satellite system time (34) with regard to a comparison between received location coordinates (32) and items of received location information (29) instantaneously delivered through said navigational receiver (20) from said satellites (23).

* * * * *